United States Patent [19]

Grandin et al.

[11] 4,115,685

[45] Sep. 19, 1978

[54] RESISTIVE HEATING OF ELONGATED STOCK

[75] Inventors: Friedrich-Hans Grandin; Werner Fritsch, both of Ratingen; Günter Wengenrod, Mülheim, all of Fed. Rep. of Germany

[73] Assignee: Mannesmann Aktiengesellschaft, Dusseldorf, Fed. Rep. of Germany

[21] Appl. No.: 812,337

[22] Filed: Jul. 1, 1977

[30] Foreign Application Priority Data

Jul. 1, 1976 [DE] Fed. Rep. of Germany ..... 2629911

[51] Int. Cl.[2] ..... C21D 9/62

[52] U.S. Cl. ..... 219/155; 219/67; 219/130.1; 219/156

[58] Field of Search ..... 219/155, 69, 59, 67, 219/130, 64, 156, 162; 148/150, 152, 154, 155

[56] References Cited

U.S. PATENT DOCUMENTS

| | | | |
|---|---|---|---|
| 3,146,336 | 8/1964 | Whitacre | 219/155 X |
| 3,290,481 | 12/1966 | Hinkel | 219/154 |
| 3,368,060 | 2/1968 | Corta | 219/155 |
| 3,398,252 | 8/1968 | Bock et al. | 219/155 X |
| 3,552,168 | 1/1971 | Svensson et al. | 219/155 |
| 3,584,178 | 6/1971 | Huber | 219/64 X |
| 3,792,684 | 2/1974 | Janatka et al. | 219/155 X |
| 3,842,239 | 10/1974 | Ellinghausen et al. | 219/155 |

FOREIGN PATENT DOCUMENTS

| | | | |
|---|---|---|---|
| 1,951,412 | 4/1971 | Fed. Rep. of Germany | 219/155 |

*Primary Examiner*—J. V. Truhe
*Assistant Examiner*—M. Paschall
*Attorney, Agent, or Firm*—Smyth, Pavitt, Siegemund, Jones & Martella

[57] ABSTRACT

Tubes, rods, etc., are heated electrically in that current is applied via movable electrodes, one of which tracks the front and another one tracks the rear ends, but the electrodes remain spaced-apart during most of the heating.

6 Claims, 3 Drawing Figures

RESISTIVE HEATING OF ELONGATED STOCK

BACKGROUND OF THE INVENTION

The present invention relates to apparatus and equipment for continuously and electrically-resistively heating elongated stock having a definite end and a definite beginning and being made of electriclaly conducted material such as metal tubes, pipes, wires, rods, etc.

Heating elongated stock while it passes through a heating station and by means of electrically resistively heating is known in a variety of configurations. It is of course necessary to conduct current into and from the stock in sliding or rolling contact fashion, as the stock passes through. If the stock, for example, is a split tube, the heating may involve only the edges, (see e.g., German Pat. No. 551,180), otherwise care must be taken to distribute the current more or less evenly in the stock. It is, however, more or less inherent in such a system that the electrodes must be spaced-apart because certain length of resistive material of the tube are needed as electrical resistance between the electrodes which otherwise would be short-circuited. It was found, however, that the known equipment does not provide for sufficient heating of the beginning and end portions of such stock. Actually, the front end and the rear end of a tube or rod or the like remains cold. If this heating device is provided for purposes of preheating stock prior to being hot or warm rolled, then it is necessary to cut off the cold ends before the stock is fed to the rolling mills. This, of course, is a cumbersome procedure. The situation is similar in the case of welding where end portions of a split tube are insufficiently welded and have to be cut off.

DESCRIPTION OF THE INVENTION

It is an object of the present invention to overcome the problems outlined above and to provide for equipment for resistively heating elongated stock under conditions which ensure adequate heating of beginning and end portions.

In accordance with the preferred embodiment of the present invention, it is suggested to provide a plurality of movable electrodes, preferably being mounted on carriages which are individually driven along the stock. The electrodes are clustered in one position when the stock arrives, but are spread in that a particular electrode on one carriage remains in contact with the advancing front end of the stock, while resistive heating with current being preferably of constant magnitude is caused to flow. The stock will be in sliding or in rolling contact with the electrodes. The electrodes and carriages remain stationary when a particular spacing has been reached. As the rear end of the stock arrives, the respective last carriage tracks the end in contact therewith while the spacing among the electrodes is reduced. After the stock has left the station, the electrodes and carriages are returned to the initial position. It is advisable to have an initial position available in which the axial spacing of the electrodes is, in fact, zero. This can be accomplished by azimuthal offsetting the points of engagement between the stock and the electrodes.

DESCRIPTION OF THE DRAWING

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
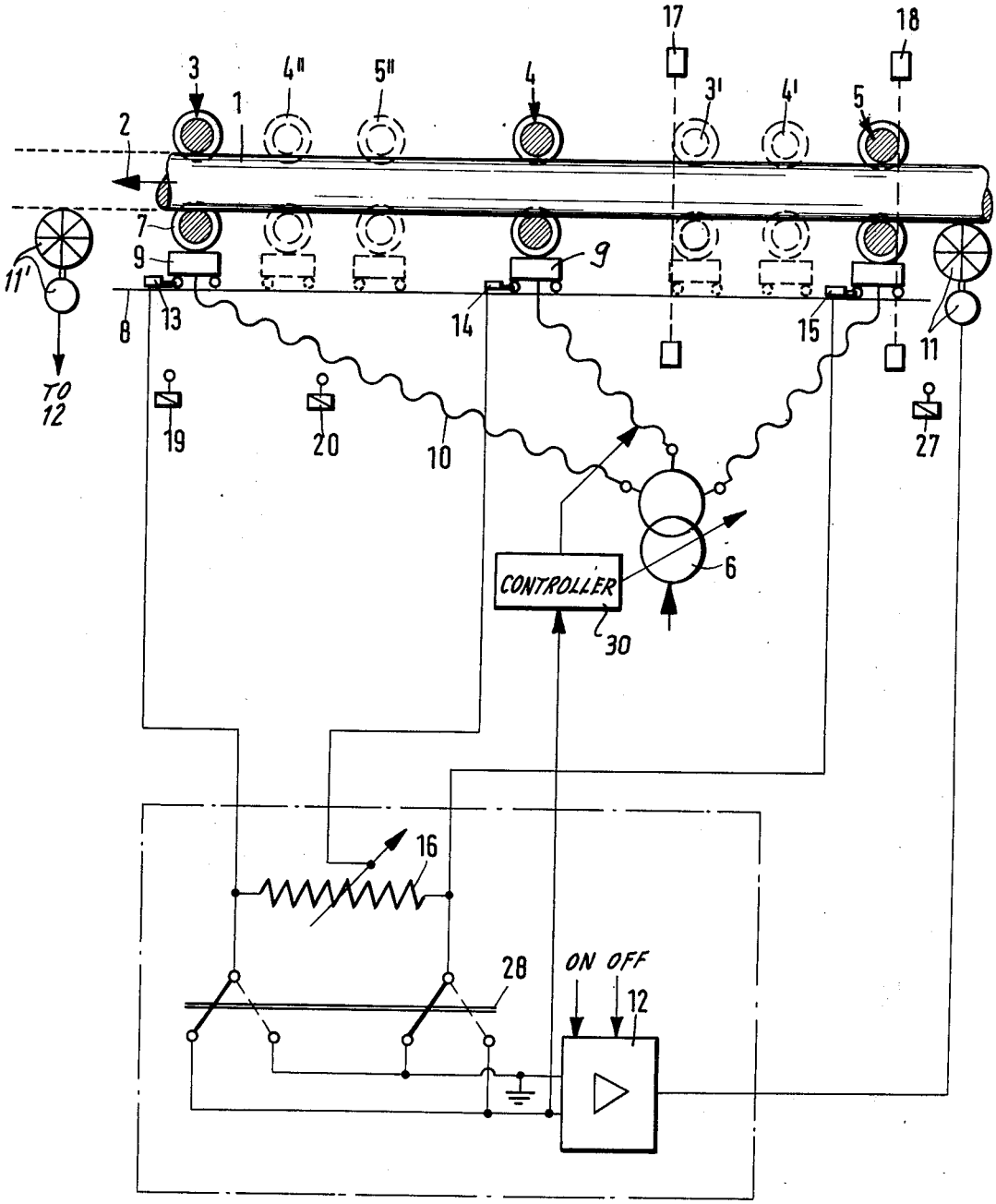
FIG. 1 is a somewhat schematic view of the entire equipment in accordance with the preferred embodiment of the present invention.

Proceeding now to the detailed description of the drawings, the station illustrated in FIG. 1 is an apparatus being provided in order to heat a tube, pipe, or rod 1.

The tube 1 is moved in the direction 2 through the station and the equipment thereof. The tube or pipe 1 is electrically-resistively heated in that station. For this, the station includes a plurality of current feed-in devices, such as 3, 4, and 5. Structure details of an example for these type of devices will be explained more fully below with reference to FIG. 2 and 3. Suffice it to say that the current feed devices each include a carriage such as 9 on which are mounted the suitable devices such as brushes or rolls 7 serving as electrodes for transmitting electrical current to a movable object such as the tube 1. The carriages 9 move on a suitable track 8 extending along the feed path for the stock 1. Each of the carriages has its own drive, there being electromotors 13, 14, and 15 accordingly.

Each of these current feed devices 3, 4, and 5 and particularly one or several rolls 7 thereof are connected to a source of electrical potential 6. By way of example, a three-phase system is shown, and the three devices 3, 4, and 5 are connected respectively to the three phases. As far as practicing the invention is concerned, this is of the preferred embodiment. However, basically, a two or single phase system or any other multi-phase system or d.c. could be used for feeding current to the tube or rod 1.

Irrespective of the type of current or phase there will always be at least two separate current feed-in devices, each being connected to a particular pole for feeding current to the tube or rod at a different locations. The current source 6 is preferably adjustable. By way of example, the source 6 may include a transformer (if the source is a.c.) and the voltage in the secondary circuit is conventionally made adjustable.

The source 6 is under control of a circuit 30 which, for example, operates as a constant current controller for keeping the output current of source 6, i.e., the average current flow to and from the electrodes constant. Reference numeral 10 refers to the individual flexible connection from the source 6 to the current feed-in devices 3, 4, and 5. A flexible connection is needed because the respective electrodes are mounted to movable carriages 9.

The system shown in FIG. 1 includes in addition a tachometer device 11, which may be a suitable roller coupled to the tube, rod, etc. 1 and faithfully reproducing the speed of the piece of stock as it passes through station. The device 11 furnishes an output voltage which, for example, has a magnitude that corresponds to the speed of the tube. Alternatively, the signal from the tachometer 11 may be an a.c. signal whose frequency varies with the speeds of the tube, rod, etc.

The particular signal being indicative of the speed of the tube is fed to a controller amplifier 12 which provides a particular control voltage. The particular tachometer 11 is placed ahead of the input side of the station (input as far as the stock 1 is concerned). A second tachometer 11' is placed at the exit side of the station, so that the speed of the stock is still ascertained even after the rear end has already paced through the input side and disengaged from tachometer 11. If the stock is moved to, through, and out of the station by means of a roller track having driven rollers, it may suffice to couple a simple tachometer to a driven track roller. If two tachometers are used, their output is averaged and applied to amplifier 12 so that the output thereof is proportional to the speed of the stock on the basis of the output of either or both tachometers.

The output voltage of amplifier 12 is fed via a switching arrangement 28 and a potentiometer 16 to the three carriage drives 13, 14, and 15, for the current feeders 3, 4, and 5, respectively. The upper output of controller amplifier 12 may also be a point of reference, i.e., it may be connected to ground. The signal level at the other output terminal of amplifier 12 varies with the speed of the stock as passing through the station. The amplifier 12 has, in addition an ON input and an OFF input receiving switching signals to turn the amplifier 12 on and off as is required during operation.

One can see that in the illustrated position of switch 28 the motor 13 will receive the full output voltage of amplifier 12. The motor 14 will receive an output signal which is reduced by the adjustment of the potentiometer 16 and the motor 15 receives no driving voltage. Speaking generally the adjustment of the potentiometer 16 is chosen in accordance with a desired distance relation of the current feeder 4 between the current feeders 3 and 5. In the illustrated example, and as will be outlined more fully below, the current feeder 4 is to have equal distances from the current feeders 3 and 5. This requires that, for example, feeder 4 moves (to the left) at half the speed as feeder 3 moving in the same direction. Thus, the potentiometer 16 will be adjusted to a 50% value. Other adjustments and correspondingly different position relations may well be desirable.

If the switch 28 changes to the dashed-line position the relationship is reversed. Motor 13 receives no voltage, motor 15 receives full voltage, and motor 14 again receives the voltage subject to the division by potentiometer 16. In either case, however, the drive voltages are proportional to the speed of the stock as passing through the station.

The system furthermore includes a number of limit switches 19, 20, and 27 which respond to the absence or presence of a carriage in a particular location. Function, purpose, position, and response of these switches will be introduced shortly.

In addition, the station includes two, for example, light barriers 17 and 18 which respond to absence and presence of a tube or pipe in the station. In particular, the light barrier 17 responds to the arrival of the front end of such a tube while light barrier 18 responds to the passage of the rear end of the tube into the station.

The output of amplifier 12 is also fed to the controller 30 so that the feed voltage be made proportional to the speed of the stock so that the heating power as supplied to each increment of stock is constant; i.e., a piece of stock that happens to travel through the station at a higher than normal speed should not be heated to a lesser extent on account of its high speed. Accordingly, the speed dependent output of amplifier 12 could be used to adjust the reference value used in controller 30 for the constant current control.

The equipment and system as described operates as follows: In a normal position, the station being empty, current feeders 3, 4, and 5 have a disposition shown in the right hand portion of the figure and represented by reference numeral 3', 4' (phantom lines), and 5. The carriages 9 are in effect very close to each other, but a small axial distance between them makes sure that the different electrodes will not be short circuited. The switch 28 has the illustrated position.

Now, a tube arrives. Before engaging the current feeders 3, 4, and 5 in the positions 3', 4', 5, the tube engages tachometer 11 which responds and provides an output signal corresponding to the speed of the tube. However, the controller amplifier 12 does not yet provide a driving voltage. As the front end of the tube passes through light barrier 17, a turn on signal is provided by the barrier 17 to turn on the amplifier 12. Accordingly, the output signal of amplifier 12 becomes effective in the carriage drive circuits.

The motor 13 for the carriage 9 of current feeder 3 receives a signal to drive that carriage at a speed equal to the speed of the tube. In other words, that particular current feeder will track, so to speak, the front end of the tube and in engagement therewith. The current feeder 4 receives a reduced signal and will, therefore, follow feeder 3 but at a reduced rate corresponding to the adjustment of potentiometer 16. The current feeder 4 will remain, for example, always halfway between the current feeders 3 and 5, if the motor 14 is driven at half the speed of the tube and of feeder 3. Carriage drive 15 remains at rest.

Concurrently to the foregoing, current is fed by the source 6 to the current feeders so that the tube 1 is heated. It can be seen that current flow commenced when the electrodes had but a small distance from each other, so that the current passes through a short section of the tube only. Thus, the constant current control reduces the voltage applied by source 6 to the electrodes. As the front carriage for the feeder 3 reaches the limit position 19, which in fact is the position illustrated in full for feeder 3 in FIG. 1, a turn off signal is provided to the controller 12 and the carriages stop. Conceivably the turn off signal may be effective only in that part of the output circuit of the output circuit of amplifier 12 through which the carriage drive voltage is furnished, so that a speed dependent output signal is continued to be applied to the controller 30. Alternatively (but quite equivalently) the turn off signal from position sense switch 19 may not be effective at all in the amplifier 12, but may operate switch 28, placing the switch into a neutral position, thus disconnecting the carriage drives from the amplifier 12 entirely.

As the bulk of the tube passes through, the current feeders 3, 4, and 5 have positions as shown in full in FIG. 1. In the meantime, the switch 28 reverses position (dashed line) which can be carried out manually, or it may well be controlled in response to the response of the limit switch 19, if the output of amplifier 12 has been turned off, at least as far as the carriage drives is concerned.

Now, it may be assumed that the end of the tube passes through the barrier 18. Accordingly, a turn-on signal is provided to turn on again the amplifier 12 to the extent it was turned off or to place switch 28 from a neutral to the dashed-line position. In either case, the tachometers 11 and 11' continue to furnish their speed indicating signal, but upon response of barrier 18, tachometer 11 disengages from the stock 1, but tachometer 11' still measures the speed.

Since the switch 28 has changed postions, a voltage is applied to the motor 15 of feeder 5, causing that carriage of that feeder to move at the speed of the tube's end. The motor 13, however, does not receive any voltage and remains in rest. And as before, the motor 14 receives a signal to move in front of the carriage of feeder 5 but at half the speed. As the devices 4 and 5 move towards the current feeder 3, the distances between the several electrodes are reduced. Constant current control 30 causes the voltage of the current source 6 to be reduced to maintain a constant level of heating.

As soon as the carriage 5 reaches a limit or end position switch 20, a turn off signal is provided for amplifier 12 and the carriages are stopped. Switch 28 may be placed to a neutral position. The stop position for the carriages is indicated in the FIG. 1 through 4'', 5''. The current feeder 3 did not change position during this tube end tracking operation. As soon as the tube leaves the station, the system stops heating. Heating may be stopped, in that position switch 20 is used to turn off source 6 entirely.

Either through programmed control or manually, the carriages for the current feeders 3, 4, and 5 reverse position, i.e., they all move back in unison and to the starting position indicated by 3', 4', and 5, and the limit or end position switch 27 stops that return movement. The carriages may stop in abutment with each other on the same track. Control here depends on the mode of the return control. By way of example, an alternative but oppositely poled voltage source may be applied to the carriage drives via switch 28, having the dashed-line position so that the carriage for feeder 5 is returned, followed by 4. When feeder 5 has the limit position to the right of the figure, switch 28 reverses and 4 completes its way while 3 follows. A separate limit switch may be provided for stopping 3 and 4 in the right positions.

Figure 2:
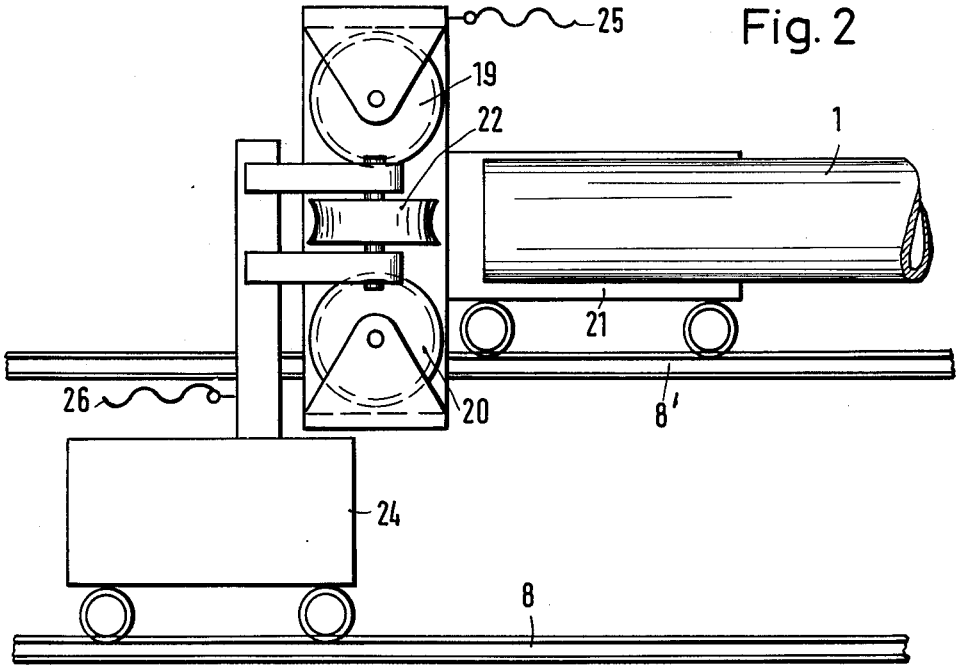
FIG. 2 is a side view of a detailed portion of the equipment shown in FIG. 1 illustrating particularly a current feed carriage.
Figure 3:
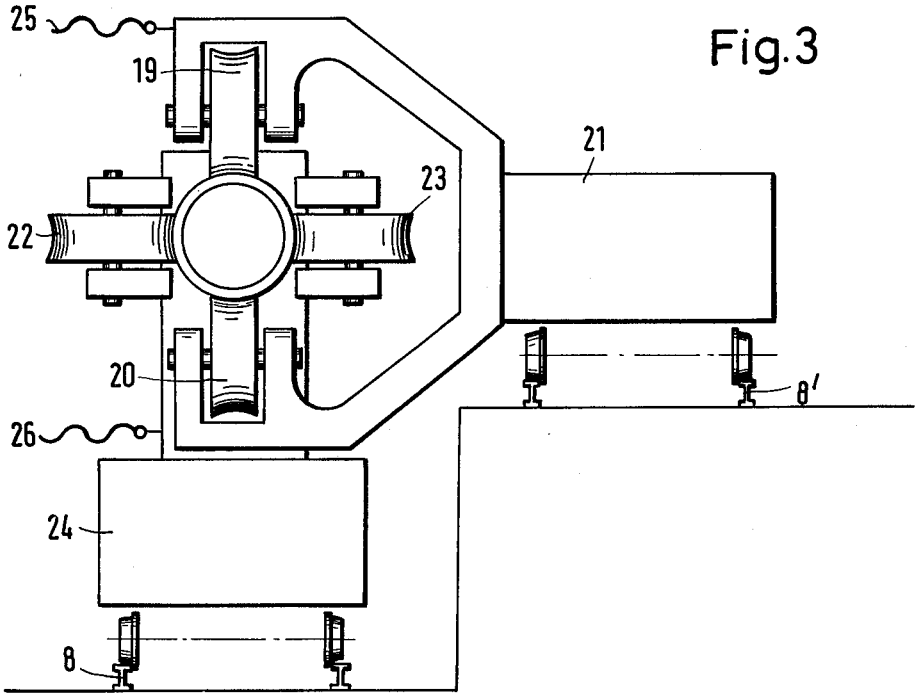
FIG. 3 is a front view of the carriage shown in FIG. 2.

The FIGS. 2 and 3 illustrate the carriages of a single phase or d.c. system. In particular there is a first carriage 21 having a bracket element for carrying two rollers 19 and 20 which engage the tube 1 in a vertical plane. Moreover, this particular carriage runs on a first, rather elevated track 8'. A second, lower track 8 is provided for a second carriage 24 carrying two rollers 22 and 23 on a horizontal bracket. The rollers, or at least one of them 19, 20, connect to a flexible conductor 25 which, for example, leads to the pole of one phase, or to one pole of a d.c. source. The respective other roller may be provided to exert counter pressure upon the tube to ensure proper contact pressure of the roller serving as electrode. It should be mentioned that the roller type electrodes may be replaced by brushes as used as collectors in electrical machines. The other rollers, or one of them, 22, 23, connect to a second flexible conductor 26 which is connected to a source of opposite potential.

The two carriages 21, 25 are shown in normal position at the front of the station which means there is no axial spacing provided as between the different rollers. In this particular case, then, the control will operate in that as the front end of a tube reaches the rollers and makes contact with them, very little current will flow because the constant current control limits any current flow through the system. The carriage 24, for example, will be driven to track and to remain in contact with the front end of the tube 1 while carriage 21 remains at rest. The tracking of the rear end is carried analogously as the carriage 21 is moved until the electrodes and rolls have again position of alignment in the radial plane, whereupon, in fact, the tube leaves the station.

For the case of a three-phase system, (being the preferred form) the pairs of rollers may be in fact tilted to each other by a 60° angle between them and the third carriage, for example, would run on tracks which, in FIG. 3 would be placed on the left hand side of the figure. FIG. 1 assumed a minimum axial spacing with all carriages placed on the same track.

The invention is not limited to the embodiments described above but all changes and modifications thereof not constituting departures from the spirit and scope of the invention are intended to be included.

We claim:

1. Apparatus for resistive heating of elongated stock such as tubes, rods, wires, etc., comprising:

a plurality of electrodes respctively in sliding or rolling contact with the stock;

means connected for feeding current to the electrodes for passage through the stock between the electrodes;

a plurality of carriages respectively for individually mounting all of the electrodes of the plurality;

drive means for each carriage for moving the respective carriage along the stock and into the different positions corresponding to differences in spacings between the electrodes of the pluralities;

means responsive to entering and leaving of a piece of stock; and means operated by said responsive means for controlling the drive means to obtain respectively an increasing of all the spacings between the electrodes as a piece of stock enters the apparatus, whereby a first one of the carriages carrying an electrode being the last one to make contact with the piece of stock, tracks the front end of the stock, and to obtain a decreasing of all the spacings between the electrodes as the piece of stock leaves the apparatus, whereby a last one of the carriages carrying an electrode being the first one to disengage from the piece of stock, tracks the rear end of the stock.

2. Apparatus as in claim 1 wherein the means for controlling include means for ascertaining the speed of the stock so that said tracking and change in spacing is controlled in proportion to the said speed.

3. Apparatus as in claim 1, there being the first, a middle and the last carriage respectively for three of the electrodes of the plurality, the means for controlling moving the first carriage together with a front end of the stock until the electrodes have a particular spacing, and moving the middle one at half the speed of the first one to be located half-way between the first and the last electrode carrying carriages, and moving the last carriage together with a rear end of stock and the middle one at half the speed until the spacing has been reduced to zero or a small value.

4. Apparatus as in claim 1 wherein the electrodes of the plurality include rolls in rolling contact with the stock, rolls being provided in an offset position to be in contact with the stock in a common plane for minimum spacing.

5. Apparatus as in claim 4 wherein for each roll there is an oppositely positioned roll.

6. Apparatus as in claim 1, including a source of voltage connected to the electrodes of the plurality, further including means for changing the voltage applied to the electrodes corresponding to the spacing.

* * * * *